US008337245B1

(12) United States Patent
Wang et al.

(10) Patent No.: US 8,337,245 B1
(45) Date of Patent: Dec. 25, 2012

(54) ELECTRICAL CONNECTOR

(75) Inventors: Yao-ting Wang, New Taipei (TW); Yu-hung Su, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/253,963

(22) Filed: Oct. 5, 2011

(51) Int. Cl.
*H01R 13/40* (2006.01)

(52) U.S. Cl. ..... 439/589; 439/271; 439/607.28; 439/901; 439/904

(58) Field of Classification Search ..... 439/271, 439/589, 607.28, 901, 904
See application file for complete search history.

(56) References Cited

U.S. PATENT DOCUMENTS 7,717,733 B1 * 5/2010 Yi et al. ..... 439/452
7,837,506 B1 * 11/2010 Chiang et al. ..... 439/607.27
7,922,535 B1 * 4/2011 Jiang et al. ..... 439/607.35
7,988,475 B2 * 8/2011 Sakakura ..... 439/271
8,052,467 B1 * 11/2011 Xie et al. ..... 439/589
8,215,996 B2 * 7/2012 Su et al. ..... 439/660
8,262,417 B1 * 9/2012 Wang et al. ..... 439/660
2011/0294345 A1 * 12/2011 Peng ..... 439/589
2012/0108095 A1 * 5/2012 Liu et al. ..... 439/271

* cited by examiner

*Primary Examiner* — James Harvey
(74) *Attorney, Agent, or Firm* — Cheng-Ju Chiang

(57) ABSTRACT

The present invention discloses an electrical connector. The electrical connector includes a terminal seat made of plastics, terminals formed in a mold on the terminal seat, a first insulative housing covered around the terminal seat, a second insulative housing sealed in a back-end of the first insulative housing, and a metal shell formed in a mold on the first insulative housing. A front surface of the first insulative housing backwardly defines a receptacle hole. The metal shell comprises an upper shell having two receiving shells respectively punch-pressed on two sides of the upper shell and comprises a lower shell defining two slots respectively corresponding to the two receiving shells. The upper shell and the lower shell are board-like and are welded together, and the slots are interconnected to the receptacle hole. The electrical connector of the present invention has a good waterproof function and a smaller metal shell.

5 Claims, 3 Drawing Sheets

ELECTRICAL CONNECTOR

FIELD OF THE INVENTION

The present invention relates to a connector, and especially to an electrical connector capable of being waterproof as well as having a smaller metal case.

BACKGROUND OF THE INVENTION

A USB is often used for data exchange between a computer and electronic products, such as a digital camera, a mobile phone, a portable hard disk, a mouse, a keyboard, a USB flash drive, and so on. It can be said that at present the USB is the most widely used peripheral bus in the computer industry and other consumer electronics industry. With flash memory capacity getting bigger and bigger, a transfer speed of the USB is upgraded as well. The USB has been upgraded to version 3.0 from 2.0 currently, and theoretically the transfer speed of the USB 3.0 is about 10 times the transfer speed of the USB2.0. Moreover, volumes of USB connectors are constantly getting smaller and smaller. In order to avoid fluid getting into an interior of the electronic products, a female mini-USB connector that is assembled on the electronic products is generally designed with a waterproof function. Generally, the female USB connector with the waterproof function includes a holding terminal seat made of plastics, a plurality of terminals disposed on the holding terminal seat, a metal case covered on the holding terminal seat, and a waterproof case made of plastics to cover around the metal case.

However, when the female USB connector is required to be disposed near an antenna in a mobile phone, as an assembling design, the metal case of the female USB connector will affect the function of the antenna in the mobile phone, even though the metal case of the female USB connector is a necessary component in order to ensure quality performance of engaging and separating the female USB connector and the male USB connector. Therefore, there is a significant need to provide an electrical connector capable of being waterproof and having a smaller metal case.

SUMMARY OF THE INVENTION

An objective of the present invention is to provide an electrical connector capable of being waterproof and having a smaller metal case in accordance with the above-mentioned drawback in the prior art.

To achieve the foregoing objectives, an electrical connector provided by the present invention is utilized for inserting into a complementary connector having two hanging elements respectively on two sides. The electrical connector includes a terminal seat made of plastics, a plurality of terminals formed in a mold on the terminal seat, a first insulative housing covered around the terminal seat, a second insulative housing sealed in a back-end of the first insulative housing, and a metal shell formed in a mold on the first insulative housing. A front surface of the first insulative housing backwardly defines a receptacle hole. The metal shell comprises an upper shell having two receiving shells respectively punch-pressed on two sides of the upper shell and comprises a lower shell defining two slots respectively corresponding to the two receiving shells. The upper shell and the lower shell are board-like and are welded together, and the slots are interconnected to the receptacle hole. When the electrical connector is inserted to the complementary connector, the hanging elements of the complementary connector are hooked at the slots and received in the receiving shell.

As mentioned above, the electrical connector of the present invention achieves being waterproof by the first insulative housing being covered around the terminal seat and the second insulative housing which is formed in a mold in the back of the first insulative housing, thereby sealing the electrical connector. Moreover, the metal shell, which consists of the board-like upper and lower shells being welded together, is formed in a mold on the first insulative housing. The lower surface of the lower shell is flushed with the upper hole-surface of the receptacle hole, and the receiving shell of the upper shell covers on the slots which are interconnected with the receptacle hole. When the electrical connector is inserted to the complementary connector, the hanging elements of the complementary connector are hooked at the slots and received in the receiving shell. Because the electrical connector has a smaller metal shell, the effect to the antenna can be decreased compared to the prior art.

DETAILED DESCRIPTION OF THE PREFERRED EMBODIMENTS

Reference will now be made in detail to the present preferred embodiment of the invention, example of which is illustrated in the accompanying drawings.

Figure 1:
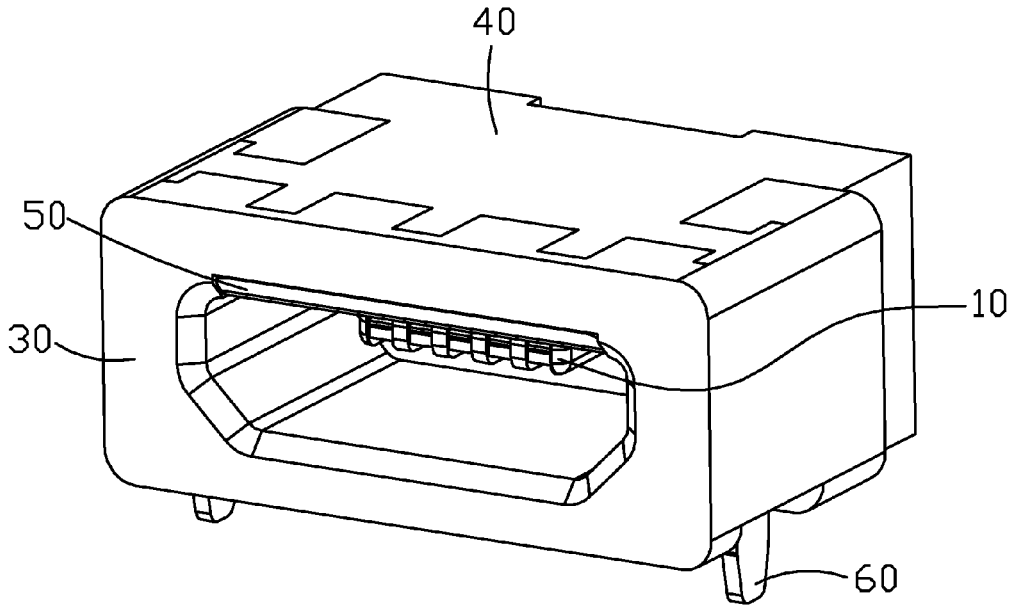
FIG. 1 is a perspective view illustrating an electrical connector according to of the present invention.
Figure 2:
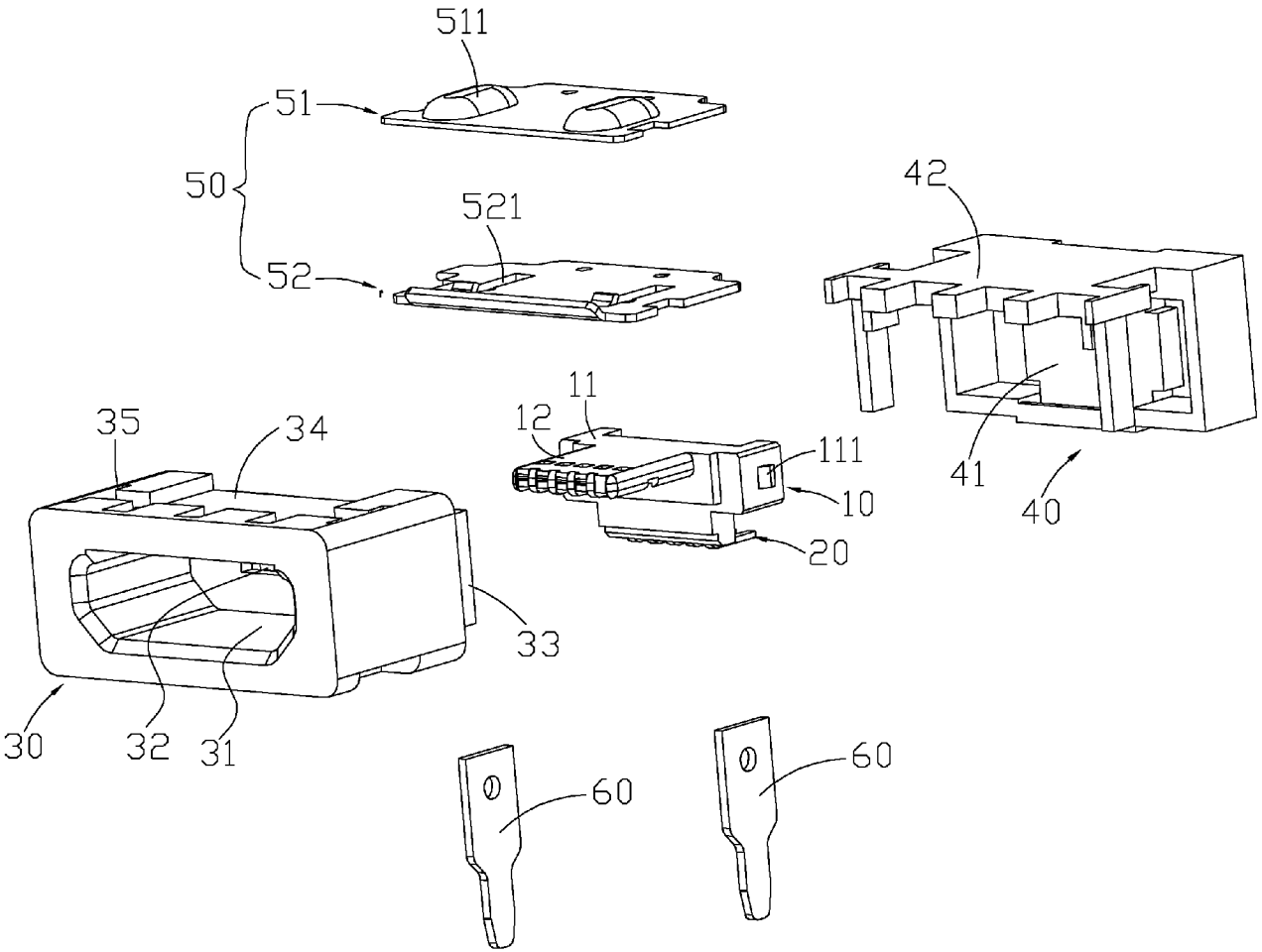
FIG. 2 is an exploded view illustrating the electrical connector of FIG. 1.

Referring to FIG. 1 and FIG. 2, an electrical connector of the present invention is utilized to be inserted into a complementary connector (not shown) having two hanging elements (not shown) respectively on two sides thereof. The electrical connector of the embodiment is a female USB connector, and the complementary connector is a male USB connector.

The electrical connector includes a terminal seat 10 which is made of plastics, a plurality of terminals 20 formed in a mold on the terminal seat 10, a first insulative housing 30 covered around the terminal seat 10, a second insulative housing 40 sealed in a back-end of the first insulative housing 30, and a metal shell 50 formed in a mold on the first insulative housing 30.

Referring to FIG. 2, the terminal seat 10 has a block-shaped main body 11 that has a tongue portion 12 protruding from a front of the main body 11. Terminal slots (not shown) that penetrate the main body 11 are defined on the tongue portion 12, and two retaining blocks 111 are convexly disposed on two sides of the main body 11. The terminals formed in a mold are on the terminal seat 10.

Figure 3:
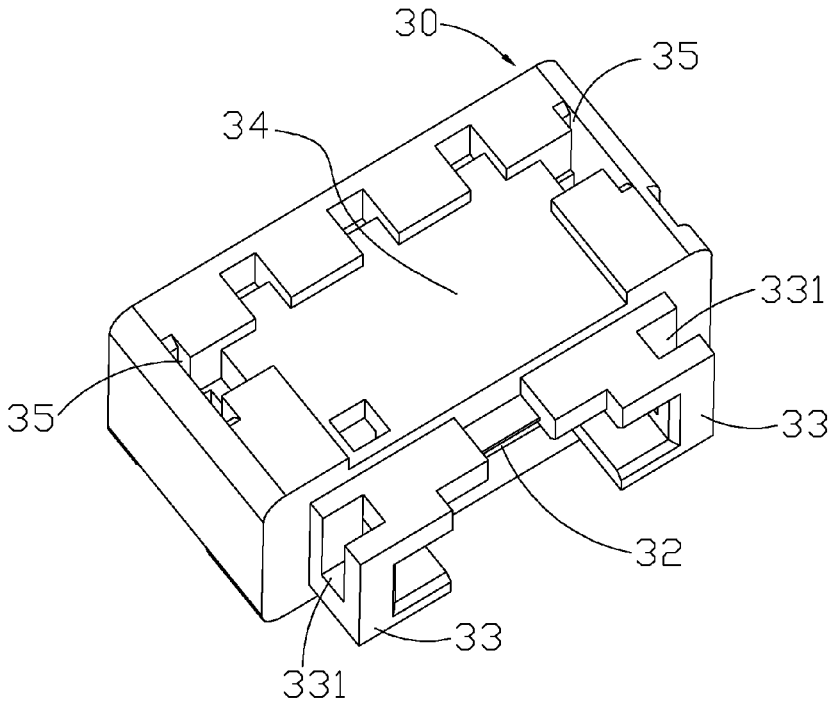
FIG. 3 is a perspective view illustrating a first insulative housing of the electrical connector shown in FIG. 1.

Referring to FIG. 2 and FIG. 3, a front surface of the first insulative housing 30 backwardly defines a receptacle hole 31, and a rear surface of the first insulative housing 30 defines an opening 32 which is interconnected with the receptacle hole 31. The tongue portion 12 of the terminal seat 10 protrudes out of the receptacle hole 31 via the opening 32. Engaging portions 33 are convexly disposed around the opening 32 on the rear surface of the first insulative housing 30, and the engaging portions 33 are configured to hold the main body 11 of the terminal seat 10. Two sides of the engaging portion 33 define an engaging groove 311 mating with the retaining block 111 of the terminal seat 10. A top surface of the first insulative housing 30 defines an engaging recess 34 penetrating backwards, and two assembling slots 35 are defined on two sides of a top surface of the first insulative housing 30.

The second insulative housing 40 includes a back cover 41 and a latching portion 42 extending from a top of the back cover 41, and both of the back cover 41 and the latching portion 42 mate with the engaging recess 34 of the first insulative housing 30.

The metal shell 50 includes an upper shell 51 that has two receiving shells 511 respectively punch-pressed on two sides of the upper shell 51 and includes a lower shell 52 that defines two slots 521 respectively corresponding to the two receiving shells 511. The upper shell 51 and the lower shell 52 are board-like and are welded together. The metal shell 50 formed in a mold is on the first insulative housing 30. Furthermore, a lower surface of the lower shell 52 is flushed with an upper hole-surface of the receptacle hole 31, and the slots 521 are interconnected to the receptacle hole 31. While the electrical connector is inserted to the complementary connector, the hanging elements of the complementary connector are hooked at the slots 521 and received in the receiving shell 511.

Figure 4:
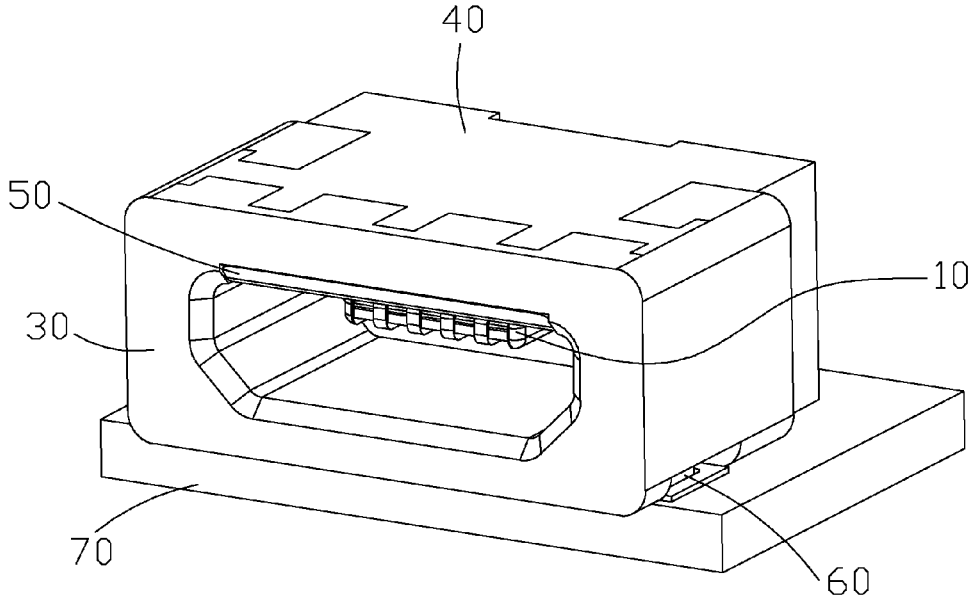
FIG. 4 is a perspective view illustrating the electrical connector mounted on an external circuit board.

The electrical connector further includes two flux sheets 60, which are welded on an external circuit board 70 via the assembling slot 35, as shown in FIG. 4.

In accordance with the electrical connector of the present invention, a assembling method thereof includes the steps of: firstly, form terminal 20 in a mold on the terminal seat 10 and to weld the upper shell 51 and the lower shell 52 together; then form the welded upper shell 51 and lower shell 52 in a mold on the first insulative housing; subsequently, to mount the terminal seat 10 that is assembled with the terminals 20 on the first insulative housing 30 having the metal shell 50, wherein the tongue portion 12 protrudes into the receptacle hole 31, and the main body 11 is engaged in the engaging portion 33, and the retaining blocks 111 is held on the engaging grooves 331; then put the assembled terminal seat 10, terminal 20, first insulative housing 30, and metal shell 50 into a mold together, as well as form the second insulative housing 40 in a mold on the back thereof, and then seal the back cover 41 over the back of the first insulative housing 30; and finally to make the flux sheet 60 pass through the assembling slots 35, wherein the lower ends of the flux sheets 60 are exposed out of the first insulative housing 30. The electrical connector of the present invention can be welded on the external circuit board via the terminals 20 and the flux sheets 60.

As mentioned above, the electrical connector of the present invention achieves the waterproof function through the first insulative housing 30 covered around the terminal seat 10 and the second insulative housing 40 formed in a mold in the back of the first insulative housing 30, thereby sealing the electrical connector. Moreover, the metal shell 50, which consists of the board-like upper shell 51 and lower shell 52 being welded together, is formed in a mold on the first insulative housing 30. The lower surface of the lower shell 52 is flushed with an upper hole-surface of the receptacle hole 31, and the receiving shell 511 of the upper shell 51 covers on the slots 521 which are interconnected with the receptacle hole 31. While the electrical connector is inserted to the complementary connector, the hanging elements of the complementary connector are hooked at the slots 521 and received in the receiving shell 511, thereby ensuring the performances of engaging and separating by the smaller metal shell so as to reduce the effect on the antenna.

What is claimed is:

1. An electrical connector for coupling to a complementary connector, comprising:

a terminal seat;

a plurality of terminals formed in a mold on the terminal seat;

a first insulative housing covering around the terminal seat, a front surface of the first insulative housing backwardly defining a receptacle hole;

a second insulative housing sealed in a back-end of the first insulative housing; and an metal shell formed in a mold on the first insulative housing, the metal shell comprising an upper shell having two receiving shells respectively punch-pressed on two sides of the upper shell and comprising a lower shell defining two slots respectively corresponding the two receiving shells, wherein the upper shell and the lower shell are board-like and are welded together, and the slots are interconnected to the receptacle hole.

2. The electrical connector of claim 1, wherein a lower surface of the lower shell is flushed with an upper hole-surface of the receptacle hole.

3. The electrical connector of claim 1, wherein the terminal seat has a block-shaped main body having a tongue portion protruding from a front of the main body and having two retaining blocks convexly disposed on two sides of the main body, and a rear surface of the first insulative housing defines an opening which is interconnecting with the receptacle hole, and an engaging portion is convexly disposed around the opening on the rear surface of the first insulative housing and is configured to hold the main body of the terminal seat, and the tongue portion of the terminal seat protrudes out of the receptacle hole via the opening, and two sides of the engaging portion defines an engaging groove mating with the retaining blocks of terminal seat.

4. The electrical connector of claim 1, wherein a top surface of the first insulative housing defines an engaging recess penetrating backwards, and the second insulative housing comprises a back cover and a latching portion extending from a top of the back cover and mating with the engaging recess of the first insulative housing, the back cover is sealed in a back-end of the first insulative housing.

5. The electrical connector of claim 1, further comprising at least two flux sheets, wherein two assembling slots are defined on two sides of a top surface of the first insulative housing, and the two flux sheets penetrate the two assembling slots and two low ends of the two flux sheets are exposed out of the first insulative housing.

* * * * *